US007319394B2

(12) United States Patent
Sheller

(10) Patent No.: US 7,319,394 B2
(45) Date of Patent: Jan. 15, 2008

(54) TECHNIQUES TO CONFIGURE A REMOTE CONTROL

(75) Inventor: Nathan J. Sheller, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/975,694

(22) Filed: Oct. 26, 2004

(65) Prior Publication Data

US 2006/0087433 A1 Apr. 27, 2006

(51) Int. Cl.
*G08B 13/14* (2006.01)

(52) U.S. Cl. ..... 340/572.1; 340/10.5; 340/825.69; 340/825.71

(58) Field of Classification Search ..... 340/572.1, 340/10.5, 825.69, 825.71
See application file for complete search history.

(56) References Cited

U.S. PATENT DOCUMENTS

| | | | | |
|---|---|---|---|---|
| 6,094,156 | A * | 7/2000 | Henty | 341/176 |
| 6,157,319 | A * | 12/2000 | Johns et al. | 340/825.72 |
| 6,225,938 | B1 * | 5/2001 | Hayes et al. | 341/176 |
| 6,690,290 | B2 * | 2/2004 | Young et al. | 340/825.69 |
| 6,748,462 | B2 * | 6/2004 | Dubil et al. | 710/8 |
| 6,933,833 | B1 * | 8/2005 | Darbee | 341/175 |
| 7,005,979 | B2 * | 2/2006 | Haughawout et al. | 340/539.1 |
| 2004/0070491 | A1 * | 4/2004 | Huang et al. | 340/10.5 |

* cited by examiner

*Primary Examiner*—Jeffery Hofsass
*Assistant Examiner*—Edny Labbees
(74) *Attorney, Agent, or Firm*—Kacvinsky LLC

(57) ABSTRACT

Method and apparatus to automatically configure a remote control for use with different devices are described.

17 Claims, 4 Drawing Sheets

TECHNIQUES TO CONFIGURE A REMOTE CONTROL

BACKGROUND

Consumer electronics, such as a stereo or television, typically come equipped with a remote control to allow a user to control operations for the device from a distance. A home entertainment system may have multiple consumer electronic devices, and therefore may need a corresponding number of remote controls. A user may find this undesirable. Universal remote controls have been developed in an effort to reduce the number of remote controls needed for a given system. Configuring a universal remote control to control different devices, however, may be difficult for a user.

DETAILED DESCRIPTION

Figure 1:
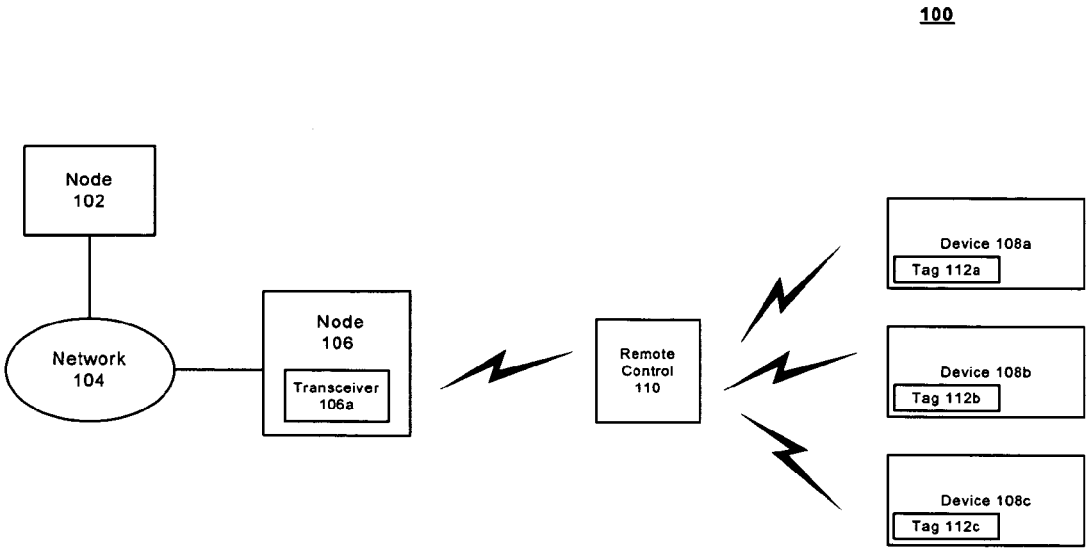
FIG. 1 illustrates a block diagram of a system 100.

FIG. 1 illustrates a block diagram of a system 100. System 100 may comprise, for example, a communication system having multiple nodes. A node may comprise any physical or logical entity having a unique address in system 100. Examples of a node may include, but are not necessarily limited to, a computer, server, workstation, laptop, ultra-laptop, handheld computer, telephone, cellular telephone, personal digital assistant (PDA), router, switch, bridge, hub, gateway, wireless access point (WAP), consumer electronics, remote control, and so forth. The unique address may comprise, for example, a network address such as an Internet Protocol (IP) address, a device address such as a Media Access Control (MAC) address, and so forth. The embodiments are not limited in this context.

The nodes of system 100 may be arranged to communicate different types of information, such as media information and control information. Media information may refer to any data representing content meant for a user, such as voice information, video information, audio information, text information, alphanumeric symbols, graphics, images, and so forth. Control information may refer to any data representing commands, instructions or control words meant for an automated system. For example, control information may be used to route media information through a system, or instruct a node to process the media information in a predetermined manner.

The nodes of system 100 may communicate media and control information in accordance with one or more protocols. A protocol may comprise a set of predefined rules or instructions to control how the nodes communicate information between each other. The protocol may be defined by one or more protocol standards as promulgated by a standards organization, such as the Internet Engineering Task Force (IETF), International Telecommunications Union (ITU), the Institute of Electrical and Electronics Engineers (IEEE), and so forth.

System 100 may be implemented as a wired system, a wireless system, or a combination of both. Although system 100 may be illustrated using a particular communications medium by way of example, it may be appreciated that the principles and techniques discussed herein may be implemented using any type of communication media and accompanying technology. The embodiments are not limited in this context.

When implemented as a wired system, system 100 may include one or more nodes arranged to communicate information over one or more wired communications media. Examples of communications media may include metal leads, printed circuit boards (PCB), backplanes, switch fabric, semiconductor material, twisted-pair wire, co-axial cable, fiber optics, and so forth. The communications media may be connected to a node using an input/output (I/O) adapter. The I/O adapter may be arranged to operate with any suitable technique for controlling information signals between nodes using a desired set of communications protocols, services or operating procedures. The I/O adapters may also include the appropriate physical connectors to connect the I/O adapters with a corresponding communications media. Examples of an I/O adapter may include a network interface, a network interface card (NIC), disc controller, video controller, audio controller, and so forth. The embodiments are not limited in this context.

When implemented as a wireless system, system 100 may include one or more wireless nodes arranged to communicate information over one or more types of wireless communication media. An example of a wireless communication media may include portions of a wireless spectrum, such as the radio-frequency (RF) spectrum. The wireless nodes may include components and interfaces suitable for communicating information signals over the designated RF spectrum. The wireless nodes may also include additional components and interfaces, such as one or more antennas, wireless RF transmitters/receivers ("transceivers"), amplifiers, filters, control logic, and so forth. Examples for the antenna may include an internal antenna, an omni-directional antenna, a monopole antenna, a dipole antenna, an end fed antenna, a circularly polarized antenna, a micro-strip antenna, a diversity antenna, a dual antenna, an antenna array, and so forth. The embodiments are not limited in this context.

Referring again to FIG. 1, system 100 may comprise various wired and wireless nodes, such as node 102, node 106, remote control 110, and devices 108*a-c*. Although FIG. 1 is shown with a limited number of elements in a certain topology, it may be appreciated that system 100 may include more or less elements in any type of topology as desired for a given implementation. The embodiments are not limited in this context.

In one embodiment, system 100 may include node 102. Node 102 may comprise a computer, server or workstation. Node 102 may also represent a single server, server farm, or other data storage infrastructure. For example, node 102 may be a web server having content accessible via network 104 using one or more Internet protocols. The embodiments are not limited in this context.

In one embodiment, system 100 may include network 104. Network 104 may comprise any type of network arranged to communicate information between the various nodes of system 100. For example, network 104 may comprise a packet data network such as a Local Area Network (LAN) or Wide Area Network (WAN), a Public Switched Telephone Network (PSTN), a wireless network such as cellular telephone network or satellite network, or any combination thereof. Network 104 may communicate information in accordance with any number of different data communication protocols, such as one or more Ethernet protocols, one or more Internet protocols such as the Transport Control Protocol (TCP) Internet Protocol (IP), Wireless Access Protocol (WAP), and so forth. The embodiments are not limited in this context.

In one embodiment, system 100 may include node 106. Node 106 may be a computer, server or workstation. For example, node 106 may comprise a personal computer (PC), such as a PC typically found in a residence or home. The embodiments are not limited in this context.

In one embodiment, node 106 may include a transceiver 106*a*. Transceiver 106*a* may comprise a wireless transceiver and antenna for communicating information using wireless communication media in accordance with one or more wireless communication protocols. For example, transceiver 106*a* may be arranged to communicate information in accordance with the IEEE 802.11 series of protocols, the IEEE 802.16 series of protocols, the Bluetooth protocol, the Ultra Wide Band (UWB) protocol, and so forth. The embodiments are not limited in this context.

In one embodiment, system 100 may include devices 108*a-c*. Devices 108*a-c* may comprise any type of electronic device that may be controlled by a remote control, such as remote control 110. Examples of electronic devices may include consumer electronics devices, such as a television, a digital video disc (DVD) player, a video cassette recorder (VCR), a digital VCR, a personal video recorder (PVR), a set top box (STB), a stereo system or individual stereo components, a digital camera, a digital camera video recorder ("camcorder"), and so forth. Although a limited number of devices are shown in system 100, it may be appreciated that any number of devices may be added to system 100 and still fall within the scope of the embodiments.

In one embodiment, devices 108*a-c* may each include a product tag 112*a-c*, respectively. Product tags 112*a-c* may comprise electronic tags that are used to uniquely identify a device. For example, product tags 112*a-c* may be implemented as radio-frequency identification (RFID) tags. RFID tags may be arranged to transmit a stream of information in response to an interrogation signal, such as an electromagnetic signal at a predetermined operating frequency. Product tags 112*a-c* may be implemented as passive or active RFID tags. Passive RFID tags typically have no power source, and rely upon the energy delivered by the interrogation signal to transmit the stream of information. Active RFID tags may have a power source such as a direct current (DC) battery or power supply, or an alternating current (AC) power supply such as the power mains for a home or office. Active RFID tags may transmit a stream of information on a continuous basis, a periodic basis, or in response to some external event. Examples of an external event may include a signal from a human being, or a device such remote control 110. The embodiments are not limited in this context.

In one embodiment, product tags 112*a-c* may be implemented as RFID tags that are arranged to communicate a device identifier in response to an interrogation signal. The device identifier may be any identifier that uniquely identifies the device. For example, the device identifier may be an electronic product code (EPC) as defined by EPCGlobal, Inc., which is a subsidiary of the Electronic Article Numbering International Group and Uniform Code Council (UCC), creators of the UPC bar code. The EPC is an electronic identifier that is an improvement of the Universal Product Code (UPC) bar code system. The EPC may comprise a 96 bit identifier that contains a number referred to as the Global Trade Identification Number (GTIN). Unlike a UPC number, which only provides information specific to a group of products, the GTIN gives each product its own specific identifying number, thereby given a greater accuracy in tracking. The embodiments, however, may use any unique identifier for devices 108*a-c*, and are therefore not limited in this context.

More particularly, the EPC may be defined and implemented in accordance with the following Version 1.0 Specifications, to include the EPC Tag Data Specification Version 1.1 (April 2004), the 900 MHz Class 0 RFID Tag Specification (February 2003), the 13.56 MHz ISM Band Class 1 RFID Tag Interface Specification (February 2003), the 860-930 MHz RFID Tag RF & Logical Communications Interface Specification (November 2002), and the Physical Markup Language (PML) Core Specification, Extensible Markup Language (XML) Schema and Instance Files (September 2003). The embodiments, however, are not limited in this context.

In one embodiment, system 100 may include remote control 110. Remote control 110 may be arranged to control, manage or operate one or more devices 108*a-c* by communicating control information to each device using infrared signals. Remote control 110 may include one or more light-emitting diodes (LED) to generate the infrared signals. The carrier frequency and data rate of such infrared signals may vary according to a given implementation. Remote control 110 may send the control information in a low-speed burst, typically for distances of approximately 30 feet or more.

Remote control 110 may control operations for a given device 108*a-c* by communicating control information to the device. The control information may include one or more infrared remote control command codes ("command codes") corresponding to various operations that the device is capable of performing. The command codes may be assigned to one or more keys or buttons included with the input device for remote control 110. There are many different types of coding systems and command codes, and generally different manufacturers may use different command codes for controlling a given device.

In one embodiment, remote control 110 may be implemented as a universal remote control. A universal remote control may be programmed or provisioned to operate a number of different devices, such as one or more of devices 108*a-c*. Each device may be arranged by the manufacturer of the device to use a predefined set of command codes. The particular set of command codes is typically preprogrammed or "hard coded" into a propriety remote control unit that comes packaged with each device. The set of command codes assigned to a given device, however, may be identified using an infrared remote identifier. For example, the command codes for each of devices 108*a-c* may be given the infrared remote identifiers of "D001", "D002" and "D003", respectively. Consequently, a universal remote control such as remote control 110 may be programmed to operate with devices 108*a-c* by entering the appropriate infrared remote identifier. In this manner, remote control 110 may replace a proprietary remote control that typically arrives with a given device or system.

Conventional techniques for programming a universal remote control, however, may be unsatisfactory for a number of reasons. For example, a user typically needs to locate the infrared remote identifier and manually enter the infrared remote identifier into the universal remote control. In another example, a device may be one of several models in a line of similar devices, with each model using a slightly different set of command codes, and therefore different infrared remote identifiers. Further, the different infrared remote identifiers may not include the complete set of command codes corresponding to the complete set of features implemented for any given device. Consequently, a user may need to try several different infrared remote identifiers before the universal remote control operates satisfactorily.

In one embodiment, remote control 110 may solve these and other problems. Remote control 110 may automatically configure itself for use with one or more devices 108*a-c*. For example, remote control 110 may transmit an RFID interrogation signal to devices 108*a-c*. The RFID interrogation signal may activate product tags 112*a-c* to transmit a device identifier, such as an EPC for the device. Remote control 110 may receive the device identifier from the device. Remote control 110 may use the device identifier to retrieve an infrared remote identifier from a list or table of infrared remote identifiers. Remote control 110 may then be provisioned to operate using a set of command codes associated with the infrared remote identifier.

The provisioning operation may include, for example, assigning a command code to individual keys or buttons of the input device for remote control 110, so a user may control operations for devices 108*a-c* in a manner similar to the proprietary remote control that typically comes with devices 108*a-c* when purchased. Alternatively, the input device for remote control 110 may be implemented as a touch panel or liquid crystal display (LCD) screen to display a "soft" keypad. In this case, the appropriate number of soft keys for a given device may be displayed and labeled with the correct function. The embodiments are not limited in this context.

Figure 2:
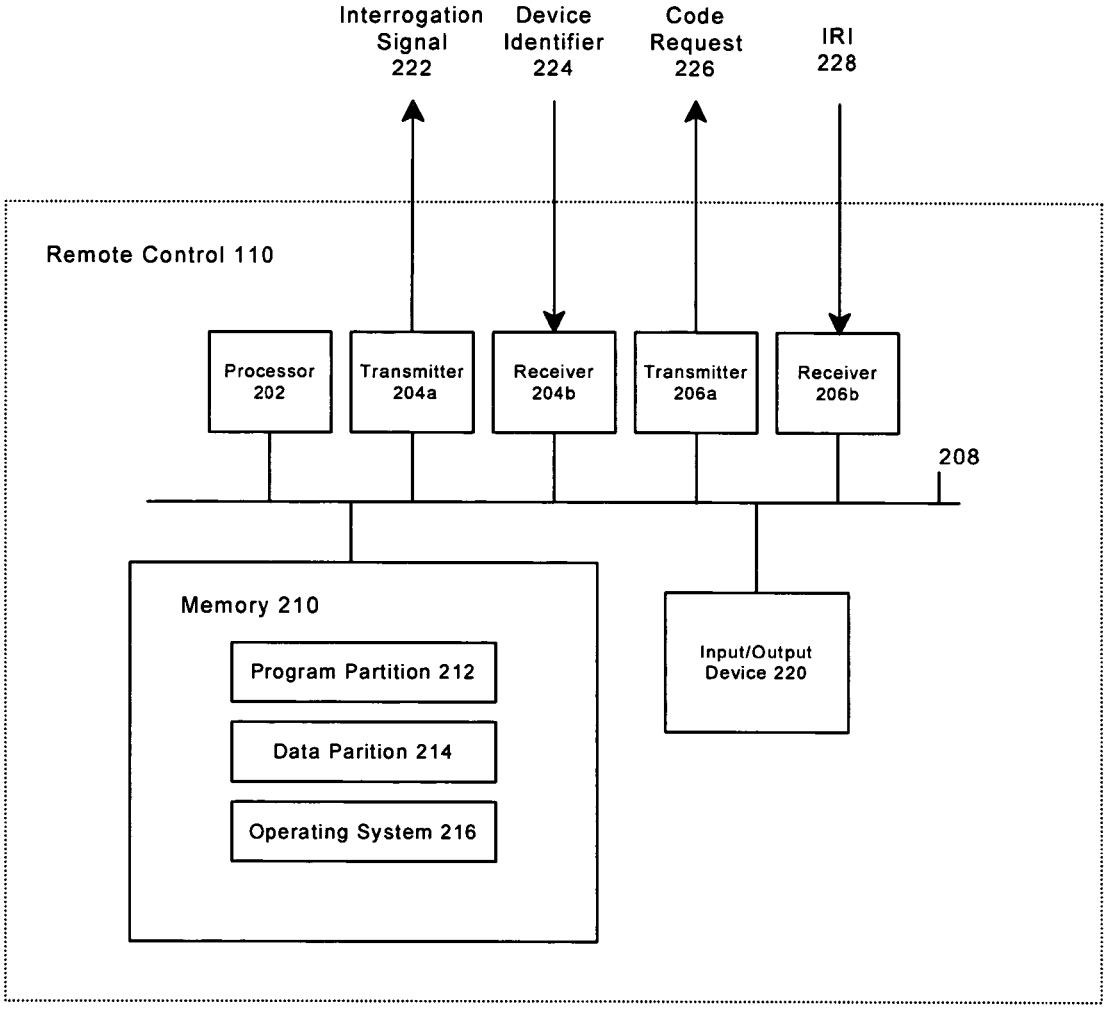
FIG. 2 illustrates a block diagram of a remote control 100.

FIG. 2 illustrates a partial block diagram of remote control 110. As shown in FIG. 2, remote control 110 may comprise multiple elements, such as processor 202, transmitters 204*a* and 206*a*, receivers 204*b* and 206*b*, memory 210, and I/O device 220, all connected via a bus 208. Some elements may be implemented using, for example, one or more circuits, components, registers, processors, software subroutines, or any combination thereof. Although FIG. 2 shows a limited number of elements, it can be appreciated that more or less elements may be used in remote control 110 as desired for a given implementation. The embodiments are not limited in this context.

In one embodiment, remote control 110 may include processor 202. Processor 202 may be implemented as a general purpose processor, such as a processor made by Intel® Corporation, for example. Processor 202 may also comprise a dedicated processor, such as a controller, microcontroller, embedded processor, a digital signal processor (DSP), a network processor, an I/O processor, and so forth. The embodiments are not limited in this context.

In one embodiment, remote control 110 may include a transceiver 204, which includes a transmitter 204*a* and receiver 204*b*. Transceiver 204 may be an RFID transceiver arranged to communicate RFID signals. For example, transmitter 204*a* may be arranged to communicate an RFID interrogation signal 222 to activate product tags 112*a-c* of devices 108*a-c*. Receiver 204*b* may be arranged to receive an RFID response signal having device identifier 224. The embodiments are not limited in this context.

In one embodiment, remote control 110 may include a transceiver 206, which includes a transmitter 206*a* and receiver 206*b*. Transceiver 206 may be any wireless transceiver arranged to communicate wireless signals between remote control 110 and node 106. Transceiver 206 of remote control 110 and transceiver 106*a* of node 106 may both be arranged to perform similar operations. As with transceiver 106*a*, transceiver 206 may therefore be arranged to operate in accordance with the IEEE 802.11 series of protocols, the IEEE 802.16 series of protocols, the Bluetooth protocol, the Ultra Wide Band (UWB) protocols, and so forth. The embodiments are not limited in this context.

In one embodiment, remote control 110 may include I/O device 220. I/O device 220 may include any input device desired for entering information into remote control 110. Examples of appropriate input devices may include a keypad, a keyboard, a touch screen, a voice activated microphone, and so forth. I/O device 220 may include any desired output devices for use in conveying information from remote control 110, such as to a user. Examples of appropriate output devices may include a display, one or more LEDs, an audio speaker, tone generator, and so forth. The embodiments are not limited in this context.

In one embodiment, remote control 110 may include a memory 210. Memory 210 may comprise any machine-readable media. Some examples of machine-readable media include, but are not limited to, read-only memory (ROM), random-access memory (RAM), dynamic RAM (DRAM), double DRAM (DDRAM), synchronous RAM (SRAM), programmable ROM, erasable programmable ROM, electronically erasable programmable ROM, flash memory, a polymer memory such as ferroelectric polymer memory, an ovonic memory, magnetic disk (e.g., floppy disk and hard drive), optical disk (e.g., CD-ROM and DVD), and so forth. The embodiments are not limited in this context.

In one embodiment, memory 210 may be used to store program instructions and data adapted to be executed by a processor, such as processor 202. Memory 210 may be accessible by processor 202 over bus 208. Memory 210 may include a program partition 212, a data partition 214, and an operating system 216. Examples of operating system 216 may include an operating system appropriate for consumer electronics or handheld devices, such as an operating system made by Microsoft® Corporation, such as Microsoft CE and Pocket PC, for example. Program partition 212 stores and allows execution by processor 202 of program instructions that implement one or more operations for the various elements described herein. Data partition 214 is accessible by processor 202 and stores data used during the execution of program instructions. Program instructions may include, for example, computer code segments comprising words, values and symbols from a predefined computer language that, when placed in combination according to a predefined manner or syntax, cause a processor to perform a certain function. Examples of a computer language may include C, C++, JAVA, assembly and so forth. The instructions may be stored on the media in a compressed and/or encrypted format. As used herein, the phrase "adapted to be executed by a processor" is meant to encompass instructions stored in a compressed and/or encrypted format, as well as instructions that have to be compiled or installed by an installer before being executed by processor 202. The embodiments are not limited in this context.

Figure 3:
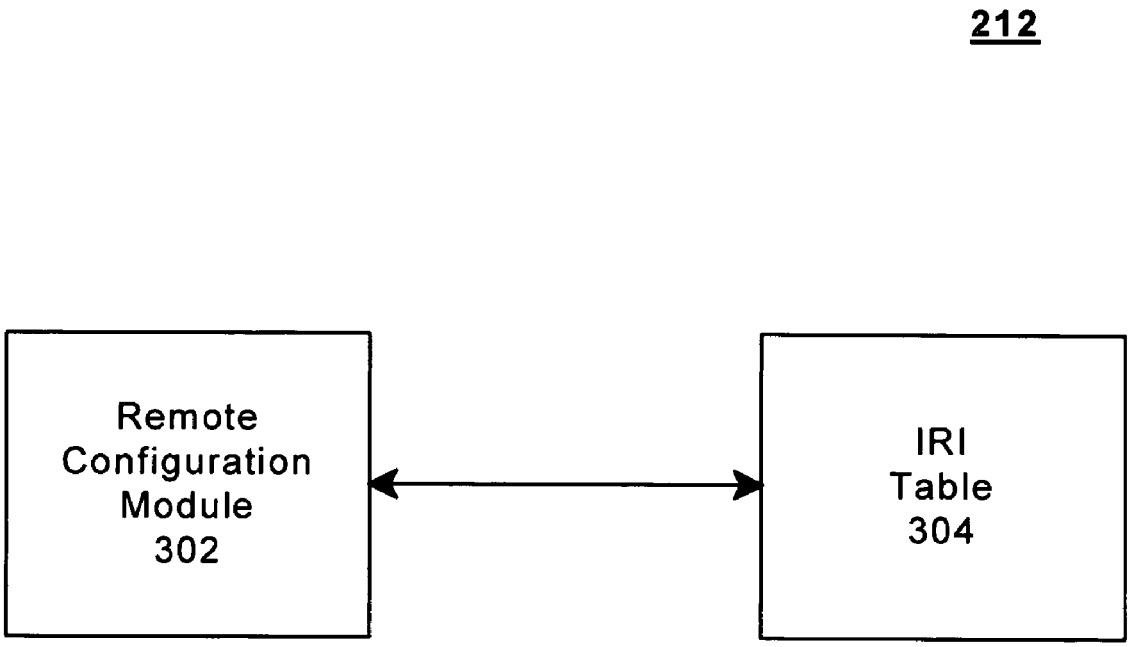
FIG. 3 illustrates a block diagram of a program partition 212.

FIG. 3 illustrates a partial block diagram of program partition 212. FIG. 3 illustrates various modules that may be stored as part of program partition 212. As shown in FIG. 3, program partition 212 may include a remote configuration module 302 and an infrared remote identifier table 304. Although remote configuration module 302 and infrared remote identifier table 304 are shown as software modules comprising program instructions for execution by processor 202, it may be appreciated that remote configuration module 302 and infrared remote identifier table 304 may be implemented using hardware, or a combination of hardware and software, and still fall within the scope of the embodiments.

In one embodiment, program partition 212 may include remote configuration module 302. Remote configuration module 302 may manage the operations for automatically configuring remote control 110 with the appropriate infrared remote identifier corresponding to a particular device. For example, remote configuration module 302 may instruct transmitter 204*a* to send an RFID interrogation signal 222 to one or more devices 108*a-c*. RFID interrogation signal 222 may activate product tags 112*a-c*. Product tags 112*a-c* may begin to transmit a device identifier 224 in response to RFID interrogation signal 222. Device identifier 224 may comprise, for example, an EPC assigned to the device. Receiver 204*b* may receive device identifier 224 from the device.

Remote configuration module 302 may search infrared remote identifier table 304 using device identifier 224. Infrared remote identifier table 304 may include a list of records, with each record including an infrared remote identifier indexed by a corresponding device identifier. Remote configuration module 302 may retrieve the appropriate infrared remote identifier corresponding to device identifier 224. Remote configuration module 302 may then provision remote control 110 with the infrared remote identifier to program remote control 110 to control one or more of devices 108*a-c*.

In some cases, device identifier 224 may have more than one infrared remote identifier. In such a case, remote configuration module 302 may notify the user via I/O device 220. The user may then select and test each infrared remote identifier to identify the one suitable for use with devices 108*a-c*. Alternatively, remote configuration module 302 may automatically test each infrared remote identifier to identify the infrared remote identifier suitable for use with devices 108*a-c*.

Remote configuration module 302 may perform automatic selection of an infrared remote identifier from multiple infrared remote identifiers in a number of different ways. For example, infrared remote identifier table 304 may arrange the multiple infrared remote identifiers in a predetermined order, e.g., from best candidate to worst candidate. In another example, infrared remote identifier table 304 may also include a list of command codes associated with each infrared remote identifier. Remote configuration module 302 may compare the list of command codes associated with each infrared remote identifier, and select the infrared remote identifier according to a predefined rule set. The rule set may be arranged, for example, to select the infrared remote identifier having the greatest number of command codes, having a certain minimum number of command codes, having a certain type of command codes, and so forth. The embodiments are not limited in this context.

As shown in FIG. 3, infrared remote identifier table 304 may be included as part of remote control 110, such as being stored in memory 210 of remote control 110, for example. In this case, infrared remote identifier table 304 may need to be updated on a periodic basis. This may be accomplished using nodes 102 and/or 106. For example, node 106 may retrieve updates for infrared remote identifier table 304 from node 102 via network 104. Node 106 may then push the updates to remote control 110. In another example, remote configuration module 302 may pull updates directly from node 106, or indirectly from node 102 via node 106 and network 104. The embodiments are not limited in this context.

The updates may be performed on a periodic basis, or in response to an internal or external event. An internal event may include an event generated by remote control 110. An example of an internal event may include when receiver 204*b* receives device identifier 224, but device identifier 224 is not found in infrared remote identifier table 304. In this case, remote configuration module 302 may send a request for update to node 106 and/or node 102. Another example of an internal event may include failure of remote control 110. In this case, remote control 110 may need to reboot, with part of the reboot operation to include loading a new infrared remote identifier table 304. An external event may include an event generated by some other device other than remote control 110. An example of an external event may include the case where a new update has been created by node 102 and/or node 106, and therefore node 102 and/or node 106 push the new updates to remote control 110. It may be appreciated that the above are merely examples, and the embodiments are not limited in this context.

In one embodiment, infrared remote identifier table 304 may be stored external to remote control 110. For example, infrared remote identifier table 304 may be stored as part of node 102 or node 106. In this case, remote configuration module 302 may instruct transmitter 206*a* to send a code request 226 to node 106. Code request 226 may include device identifier 224. Code request 226 may indicate to node 102 or node 106 that a new device has been located, and remote control 110 needs an infrared remote identifier to provision remote control 110 to operate the new device. Implementing infrared remote identifier table 304 may also reduce the complexity for any update operations, as well as potentially reducing the complexity of remote control 110.

If node 106 includes infrared remote identifier table 304, node 106 may receive code request 226 via transceiver 106*a*, and begin searching infrared remote identifier table 304 for the appropriate infrared remote identifier corresponding to device identifier 224. If the appropriate infrared remote identifier is found, node 106 may return infrared remote identifier 228 via transceiver 106*a*. Receiver 206*b* of remote control 110 may receive infrared remote identifier 228, and pass infrared remote identifier 228 to remote configuration module 302. Remote configuration module 302 may provision remote control 110 using infrared remote identifier 228. If device identifier 224 is not found in infrared remote identifier table 304, node 106 may pass code request 226 to node 102 via network 104 to retrieve the appropriate infrared remote identifier, or request an update from node 102 for infrared remote identifier table 304. Updates to infrared remote identifier table 304 implemented as part of node 106 may be handled using similar operations as described with reference to FIG. 3.

If node 102 includes infrared remote identifier table 304, node 106 may receive code request 226 via transceiver 106*a*, and pass code request 226 to node 102 via network 104. Node 102 may search infrared remote identifier table 304, and send infrared remote identifier 228 to node 106 via network 104. Node 106 may send infrared remote identifier to remote control 110 via transceiver 106*a* of node 106 and transceiver 206 of remote control 110.

Operations for the above system and subsystem may be further described with reference to the following figures and accompanying examples. Some of the figures may include programming logic. Although such figures presented herein may include a particular programming logic, it can be appreciated that the programming logic merely provides an example of how the general functionality described herein can be implemented. Further, the given programming logic does not necessarily have to be executed in the order presented unless otherwise indicated. In addition, the given programming logic may be implemented by a hardware element, a software element executed by a processor, or any combination thereof. The embodiments are not limited in this context.

Figure 4:
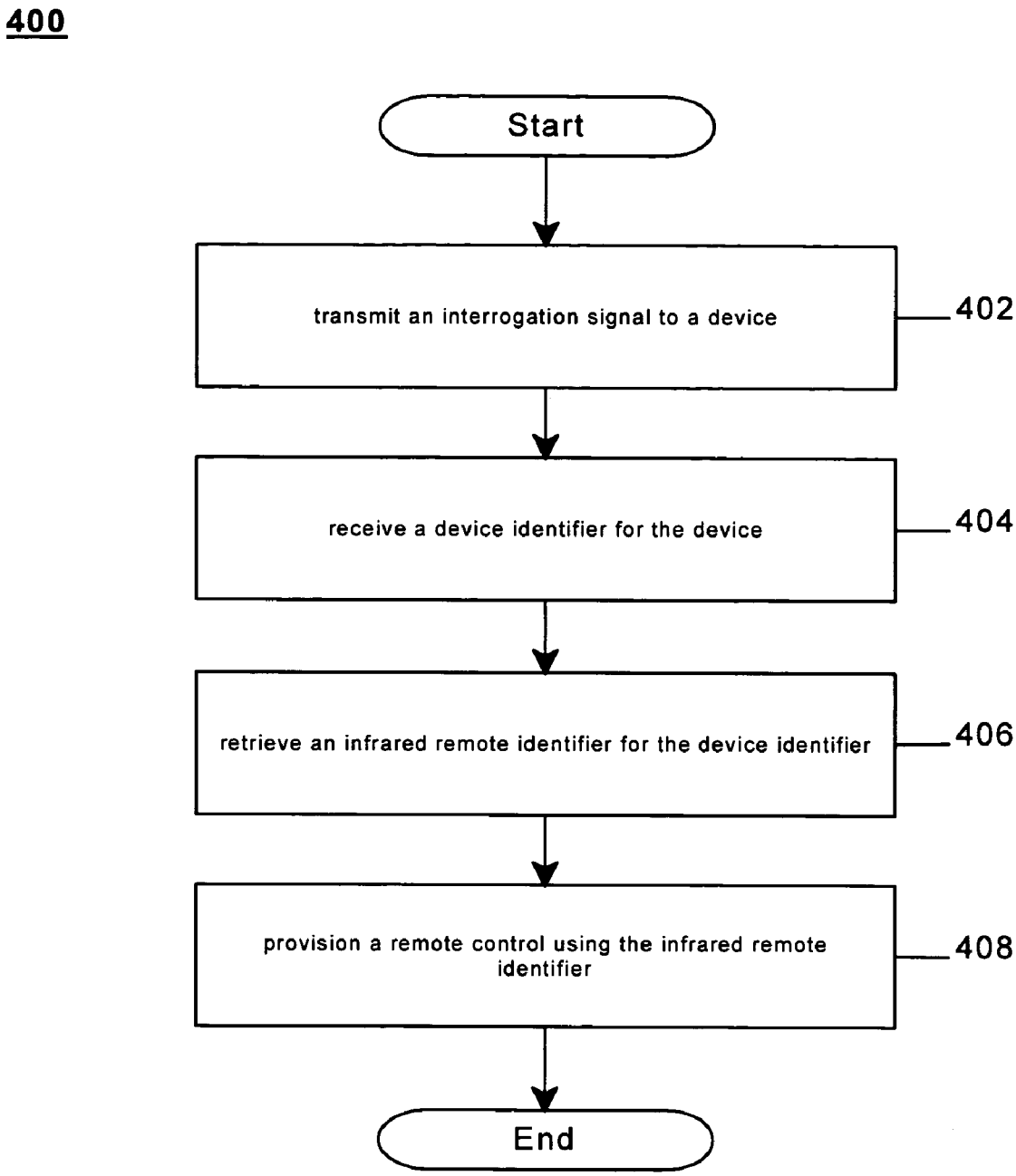
FIG. 4 illustrates a block diagram of a programming logic 400.

FIG. 4 illustrates a programming logic 400. Programming logic 400 may be representative of the operations executed by one or more systems described herein, such as system 100 and/or remote control 110. As shown in programming logic 400, an interrogation signal may be transmitted to a device at block 402. A device identifier for the device may be received at block 404. An infrared remote identifier for the device identifier may be retrieved at block 406. A remote control may be provisioned using the infrared remote identifier at block 408. The provisioning may allow the remote control to control operations for the device.

In one embodiment, the infrared remote identifier may be retrieved by searching a code list for the infrared remote identifier corresponding to the device identifier. The infrared remote identifier may be retrieved from the list.

In one embodiment, the infrared remote identifier may be retrieved by establishing a first connection with a first node. A request for the infrared remote identifier with the device identifier may be sent to the first node. The infrared remote identifier may be received from the first node.

In one embodiment, the first node may retrieve the infrared remote identifier. For example, the first node may receive the request. The first node may search a code list for the infrared remote identifier corresponding to the device identifier. The first node may send the infrared remote identifier when found.

In one embodiment, a second node may retrieve the infrared remote identifier. For example, the first node may receive the request. The first node may establish a second connection with a second node. The first node may send the request to the second node. The second node may search for the infrared remote identifier corresponding to the device identifier. The second node may send the infrared remote identifier to the first node. The first node may receive the infrared remote identifier, and send the infrared remote identifier when received from the second node.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Some embodiments may be implemented using an architecture that may vary in accordance with any number of factors, such as desired computational rate, power levels, heat tolerances, processing cycle budget, input data rates, output data rates, memory resources, data bus speeds and other performance constraints. For example, an embodiment may be implemented using software executed by a general-purpose or special-purpose processor. In another example, an embodiment may be implemented as dedicated hardware, such as a circuit, an application specific integrated circuit (ASIC), Programmable Logic Device (PLD) or DSP, and so forth. In yet another example, an embodiment may be implemented by any combination of programmed general-purpose computer components and custom hardware components. The embodiments are not limited in this context.

Some embodiments may be implemented, for example, using a machine-readable medium or article which may store an instruction or a set of instructions that, if executed by a machine, may cause the machine to perform a method and/or operations in accordance with the embodiments. Such a machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, CD-ROM, CD Recordable (CD-R), CD Rewriteable (CD-RW), optical disk, magnetic media, various types of DVD, a tape, a cassette, or the like. The instructions may include any suitable type of code, such as source code, compiled code, interpreted code, executable code, static code, dynamic code, and the like. The instructions may be implemented using any suitable high-level, low-level, object-oriented, visual, compiled and/or interpreted programming language, such as C, C++, Java, BASIC, Perl, Matlab, Pascal, Visual BASIC, assembly language, machine code, and so forth. The embodiments are not limited in this context.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or display devices. The embodiments are not limited in this context.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

The invention claimed is:

1. An apparatus, comprising:

a remote control, said remote control having a first transmitter, a first receiver and a remote configuration module, said first transmitter to transmit an interrogation signal to a device, said first receiver to receive a device identifier for said device, and said remote configuration module to provision said remote control with an infrared remote identifier for said device identifier, the infrared remote identifier to configure said remote control to send control information to said device;

wherein said remote control further comprises a second transmitter and a second receiver, said second transmitter to transmit a request for said infrared remote identifier to a first node, said request including said device identifier, and said second receiver to receive said infrared remote identifier from said first node.

2. The apparatus of claim 1, wherein said device identifier comprises an electronic product code.

3. The apparatus of claim 1, further comprising a memory unit, said memory unit to store an infrared remote control identifier table, said table having infrared remote identifiers indexed by device identifiers.

4. The apparatus of claim 3, wherein said infrared remote control identifier table includes multiple infrared remote identifiers for at least one device identifier.

5. A system comprising:

a device having a radio-frequency identification tag, said radio-frequency identification tag to communicate a device identifier in response to an interrogation signal; and a remote control to remotely control said device, said remote control having a first antenna, a first transmitter, a first receiver and a remote configuration module, said first transmitter to transmit an interrogation signal to said device using said first antenna, said first receiver to receive a device identifier for said device using said first antenna, and said remote configuration module to provision said remote control with an infrared remote identifier for said device identifier;

wherein said remote control further comprises a second antenna, a second transmitter and a second receiver, said second transmitter to transmit a request for said infrared remote identifier to a first node using said second antenna, said request including said device identifier, and said receiver to receive said infrared remote identifier from said first node using said second antenna, the infrared remote identifier to configure said remote control to send control information to said device.

6. The system of claim 5, wherein said device identifier comprises an electronic product code.

7. The system of claim 5, further comprising a memory unit, said memory unit to store an infrared remote control identifier table, said table having infrared remote identifiers indexed by device identifiers.

8. The system of claim 7, wherein said infrared remote control identifier table includes multiple infrared remote identifiers for at least one device identifier.

9. The system of claim 5, further comprises said first node, said first node having a memory unit to store an infrared remote identifier table, said table having infrared remote identifiers indexed by device identifiers, said remote control to establish a connection with said first node, send said request for said infrared remote identifier to said first node, and to receive said infrared remote identifier from said first node.

10. A method, comprising:

transmitting from a remote control an interrogation signal to a device capable of being controlled remotely;

receiving at said remote control a device, identifier for said device;

sending from said remote control a request for an infrared remote identifier to a first node, said request including said device identifier;

receiving at said remote control said infrared remote identifier from said first node; and provisioning said remote control using said infrared remote identifier.

11. The method of claim 10, including:

searching a code list for said infrared remote identifier corresponding to said device identifier; and retrieving said infrared remote identifier from said list.

12. The method of claim 10, including:

receiving said request at said first node;

searching a code list for said infrared remote identifier corresponding to said device identifier; and sending said infrared remote identifier from said first node.

13. The method of claim 10, including:

receiving said request at said first node;

establishing a second connection with a second node;

sending said request to said second node;

receiving said infrared remote identifier from said second node; and sending said infrared remote identifier from said first node.

14. An article comprising a medium storing instructions that when executed by a processor are operable to transmit an interrogation signal from a remote control to a device capable of being controlled remotely, receive at said remote control a device identifier for said device, send from said remote control a request for an infrared remote identifier to a first node, receive at said remote control said infrared identifier from said first node, and provision said remote control using said infrared remote identifier; wherein said request includes said device identifier.

15. The article of claim 14 further storing instructions that when executed by a processor are operable to search a code list for said infrared remote identifier corresponding to said device identifier, and retrieve said infrared remote identifier from said list.

16. The article of claim 14 further storing instructions that when executed by a processor are operable to receive said request at said first node, search a code list for said infrared remote identifier corresponding to said device identifier, and send said infrared remote identifier from said first node.

17. The article of claim 14 further storing instructions that when executed by a processor are operable to receive said request at first node, establish a second connection with a second node, send said request to said second node, receive said infrared remote identifier from said second node, and send said infrared remote identifier from said first node.

* * * * *

UNITED STATES PATENT AND TRADEMARK OFFICE

CERTIFICATE OF CORRECTION

PATENT NO. : 7,319,394 B2
APPLICATION NO. : 10/975694
DATED : January 15, 2008
INVENTOR(S) : Sheller It is certified that error appears in the above-identified patent and that said Letters Patent is hereby corrected as shown below:

In column 12, line 1, in Claim 10, after "device" delete ",".

Signed and Sealed this

Thirteenth Day of May, 2008

JON W. DUDAS
*Director of the United States Patent and Trademark Office*